United States Patent [19]

White

[11] Patent Number: 4,940,215

[45] Date of Patent: Jul. 10, 1990

[54] TILTABLE LADLE WITH LID

[75] Inventor: Douglas S. White, Cap D'Antibes, France

[73] Assignee: Elkem a/s, Norway

[21] Appl. No.: 374,965

[22] Filed: Jun. 30, 1989

[30] Foreign Application Priority Data

Aug. 4, 1988 [NO] Norway ..... 883454

[51] Int. Cl.[5] ..... C21B 11/00

[52] U.S. Cl. ..... 266/275; 222/604; 222/605

[58] Field of Search ..... 266/275, 276, 142, 240; 222/604, 605

[56] References Cited

U.S. PATENT DOCUMENTS

| | | | |
|---|---|---|---|
| 3,201,224 | 8/1965 | Grim | 222/604 |
| 3,507,421 | 4/1970 | Eickelberg et al. | 222/604 |
| 4,118,018 | 10/1978 | Gruner et al. | 266/275 |
| 4,488,711 | 12/1984 | Isenberg et al. | 222/604 |

*Primary Examiner*—S. Kastler

*Attorney, Agent, or Firm*—Lucas & Just

[57] ABSTRACT

The present invention relates to a cover for a tiltable ladle said cover having a pouring basin with at least one opening in its bottom communicating with the ladle. The cover is suspended in the horizontal beam of a ladle support frame by springs, said springs being intended to lift the cover away from the top of the ladle when the pouring basin is empty.

14 Claims, 3 Drawing Sheets

TILTABLE LADLE WITH LID

Figure 1:
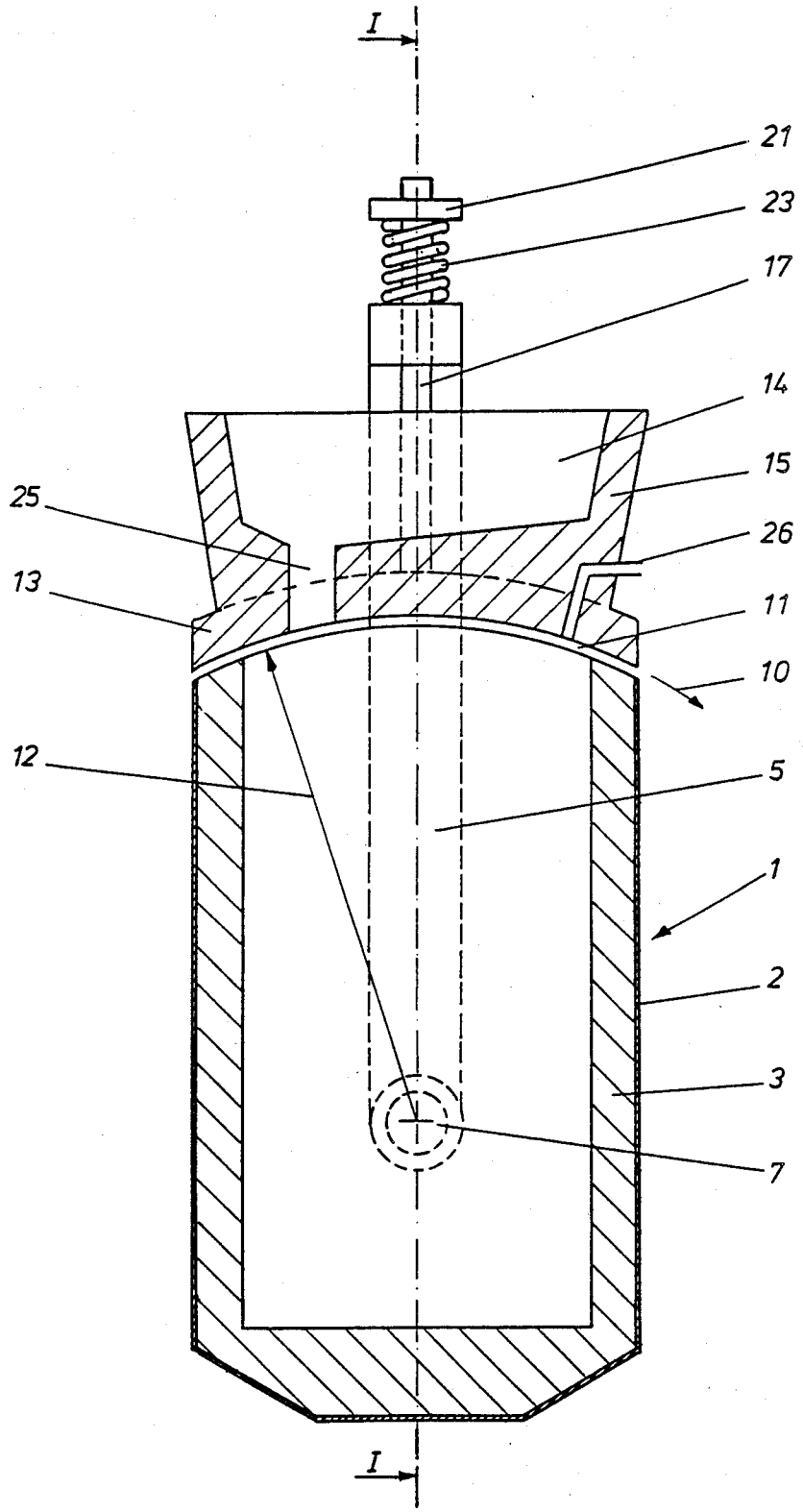

The present invention relates to a cover for a tiltable ladle for molten metal, such as a ladle for cast iron and steel.

In some cases it is desirable to have a ladle closed with a cover during filling with molten metal. This may be to prohibit reactions with the atmosphere, to contain within the ladle pollutions which might be generated with materials previously placed in the ladle, etc.

To achieve this, covers have been previously designed having a pouring basin built into the construction on top of the cover. This is known from a variety of forms which are generally called "tundish covers". In some cases the tundish covers are bolted to the top of the ladle, and in other cases it is a loose assembly with the cover being raised or removed to allow ladle tilting.

The removeable cover type may be selected depending on circumstances such as the need for slag removal before transferring the iron to ladles or holding or autopour furnaces, or casting the iron.

Cover handling is particularly a problem in the case where cast iron is treated with a magnesium-containing additive in a ladle. In this process the magnesium containing additive is placed in an empty ladle whereafter molten cast iron is poured into the ladle. The reaction between the molten iron and the magnesium containing additive is violent and it is therefore necessary to use a ladle cover during the pouring process in order to avoid escape of magnesium-containing gases to the environment. The use of known ladle covers causes a number of problems during this process. Thus excessive heat losses occur if the cover is off the ladle too long. Labour costs for handling of the cover is high. Time loss occurs due to handling of the cover, and the known mechanisms to raise and lower the cover are costly, and sometimes unreliable.

It is an object of the present invention to provide a tundish cover for tiltable ladles whereby the cover is in place with the ladle top when the ladle is being filled with molten iron, and is automatically away to allow freedom of ladle tilting at all other times.

Accordingly, the present invention relates to a cover for a tiltable ladle, said cover having a pouring basin with at least one opening in its bottom communicating with the ladle, and wherein the cover is suspended in the ladle support frame by springs, said springs being designed to lift the cover away from the top of the ladle when the pouring basin is empty.

When the ladle cover according to the present invention is used for a tiltable ladle for treating cast iron with a magnesium-containing additive, the ladle is tilted away from the cover and the magnesium-containing additive is placed in the ladle. The ladle is now tilted back to its vertical position and the cast-iron to be treated is poured into the pouring basin in the ladle cover. As soon as a certain weight of metal is filled into the pouring basin of the cover, the springs are compressed whereby the ladle cover is lowered into contact with the top of the ladle. The cover now partly seals off the ladle, a reducable volume of gases is allowed to escape from the ladle. The pouring of iron into the pouring basin is now continued at the same rate as the iron flows through the opening in pouring basin and into the ladle. This situation is continued until the preset amount of cast iron has been poured. When the pouring of cast iron into the pouring basin is stopped, the pouring basin will be emptied and the springs will thereby expand and automatically lift the cover off the ladle. The ladle is immediately ready for tilting and casting of the treated cast iron contained in the ladle.

By the ladle cover of the present invention, the drawbacks of the known ladle covers are overcome. Thus time loss due to handling of the cover is completely avoided. Further, when the ladle cover has been installed on a ladle, there is no need for manually handling of the cover as the cover is automatically lowered and lifted away from the ladle.

Figure 2:
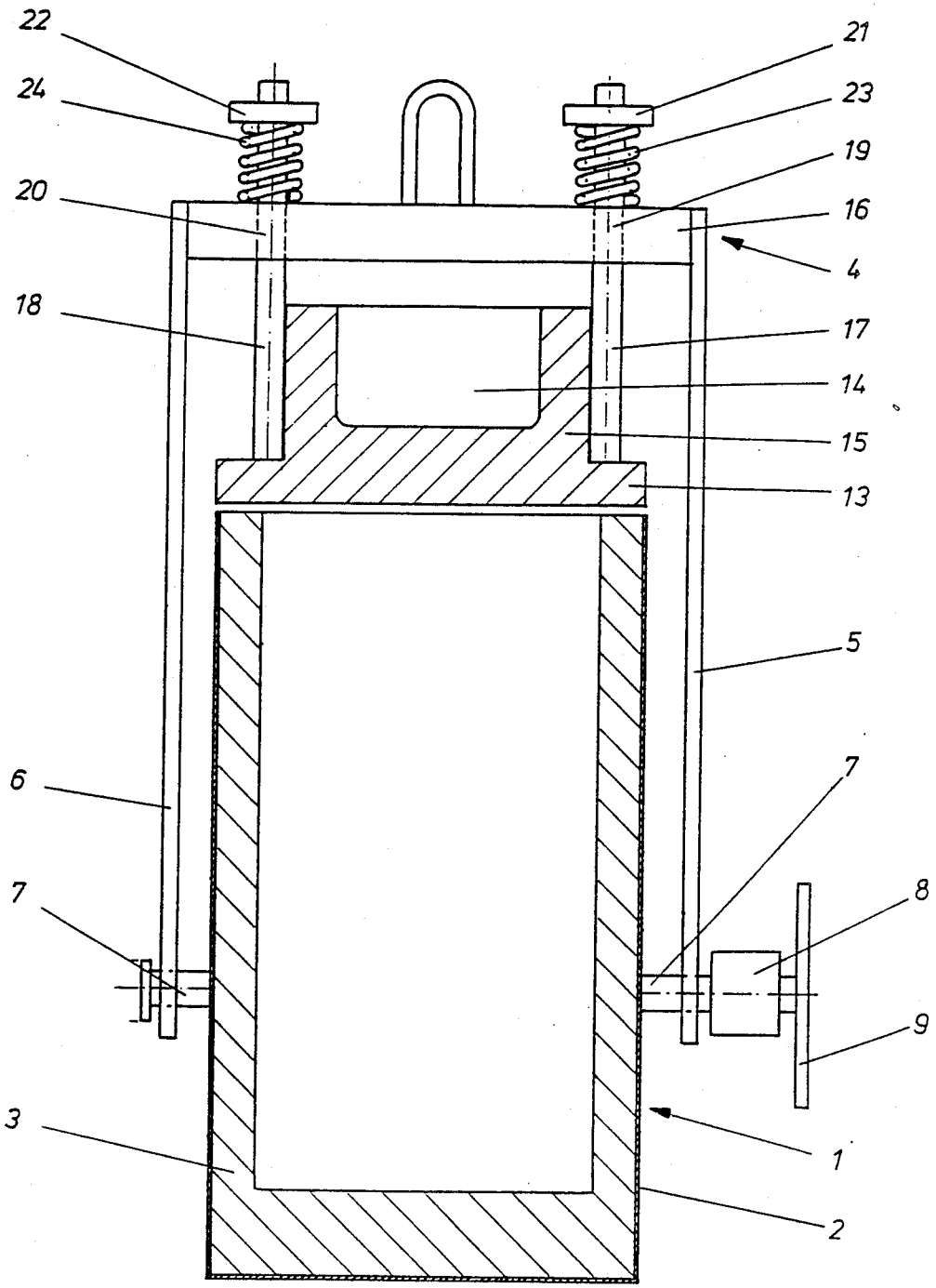
Figure 3:
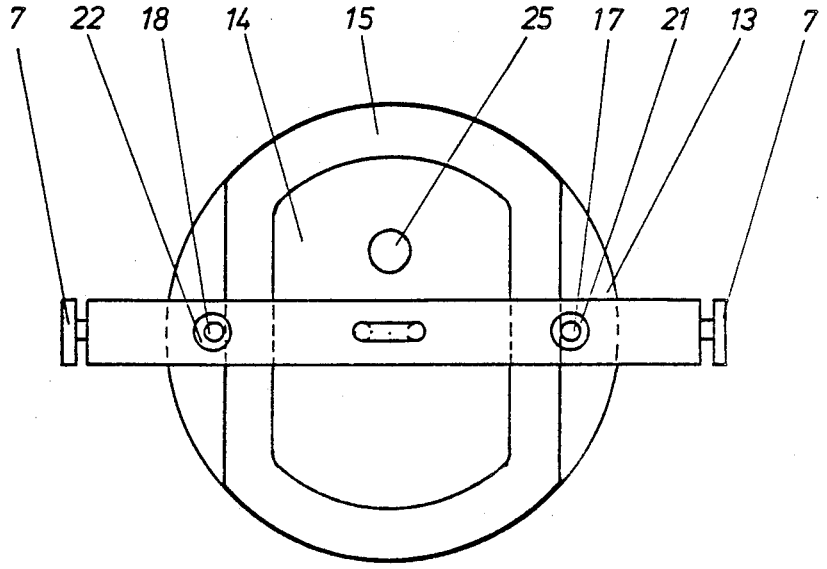

The present invention will now be further described with reference to the accompanying drawings in which:

FIG. 1 shows a side elevation of a tilting ladle with a tundish cover according to the present invention, FIG. 2 shows a vertical section along line I—I of FIG. 1, and FIG. 3 shows a top view of the ladle cover.

On the figures there are shown a tiltable ladle 1 having an outer steel wall 2 and an inner refractory lining 3. The ladle is equipped with a suspension frame 4, having arms 5, 6 which are rotatably connected to trunnions 7 fixed to the wall 2 of the ladle 1. The ladle is further equipped with conventional tilting means, which may comprise a gear box 8 and a tilting wheel 9.

The ladle can thus be tilted in the direction shown by arrow 10 in FIG. 1.

The top of the ladle 1 is curved in the tilting direction, the curvature of the top 11 of the ladle having a radius shown by the line 12 in FIG. 1.

The ladle cover comprises a first part 13 having a lower curvature corresponding to the curvature of the top 11 of the ladle 1. On the fist part 13 of the cover there is a pouring basin 14 having walls 15. The first part 13 of the cover and the walls of the pouring basin 14 is made of a refractory material which are able to with-stand the temperature of molten cast iron. The pouring basin 14 has at least one opening 25 which communicates with the ladle 1. The complete ladle cover is suspended from a horizontal beam 16 of the suspension frame 4 by means of two rails 17, 18 which are firmly affixed to the ladle cover and which extends through two openings 19, 20 in the horizontal beam 16. The top of each of the rails 17, 18 are equipped with washers 21, 22. Between each washer 21, 22 and the top of the vertical beam 16, there are arranged springs 23, 24. As long as the pouring basin 14 is empty the springs 23, 24 are lifting the ladle cover away from the top 11 of the ladle, thereby leaving the ladle 1 free for tilting. When cast iron is poured into the pouring basin 14 the springs 23, 24 are compressed and the cover is lowered until the first part 13 of the cover seals off the top 11 of the ladle 1. In this way the cover seals off the ladle during the filling of the ladle with cast iron. As soon as the preset amount of cast iron is poured into the ladle, the pouring basin 14 is emptied and the springs 23, 24 will lift the cover away from the ladle to allow for the tilting operation of the ladle.

Preferably the cover is equipped with a vertical pipe 26 to prevent pressure build up in the sealed ladle, and to direct any pollution towards a collection system if available.

I claim:

1. A cover for a tiltable ladle wherein said cover has a basin affixed to the top of said cover and at least one opening in the basin for communicating through said cover to said ladle, said cover comprising:

(a) a suspension means for suspending said cover over said ladle, said suspension means comprises a horizontal beam affixed to said suspension frame, and two rods, each of which is attached to said cover and passes through said horizontal beam and is movable with respect to said horizontal beam, each of said two rods having a washer affixed thereto and positioned above said horizontal beam;

(b) spring means for forcing said cover away from said ladle such that when the basin in said cover is empty said cover is not in contact with said ladle, said spring means attached to said suspension means, said spring means comprising two compression springs, one of said compression springs positioned around one of said two rods and between said horizontal beam and said washer and the other of said two compression springs positioned around the other of said two rods and between said horizontal beam and said washer; and (c) the top of the ladle and the lower part of the cover have, in the tilting direction of the ladle, a curved surface with a radius equal to the distance from the tilting point of the ladle and vertically to the top of the ladle.

2. A cover arrangement for a tiltable ladle suspended from a suspension frame comprising:

(a) a cover having a pouring basin therein with at least one opening in said basin for communicating with said ladle;

(b) a suspension means for suspending said cover over said ladle; and (c) spring means for forcing said cover away from said ladle such that when the basin in said cover is empty said cover is not in contact with said ladle, said spring means attached to said suspension means.

3. The cover of claim 2 wherein said suspension means comprises a horizontal beam affixed to said suspension frame, and two rods, each of which is attached to said cover and passes through said horizontal beam and is movable with respect to said horiztonal beam, each of said two rods having a washer affixed thereto and positioned above said horizontal beam.

4. The cover of claim 3 wherein said spring means comprises two compression springs, one of said compression springs positioned around one of said two rods and between said horizontal beam and said washer and the other of said two compression springs positioned around the other of said two rods and between said horizontal beam and said washer.

5. The cover of claim 2 wherein said suspension means comprises a horizontal beam affixed to said suspension frame, and two rods, each of which is attached to said cover and passes through said horizontal beam and is movable with respect to said horizontal beam, each of said two rods having a washer affixed thereto and positioned above said horizontal beam; and said spring means comprising two compression springs, one of said compression springs positioned around one of said two rods and between said horizontal beam and said washer and the other of said two compression springs positioned around the other of said two rods and between said horizontal beam and said washer.

6. The cover arrangement of claim 2 wherein the top of the ladle and the bottom of the cover, in the tilting direction of the ladle, have a curved surface with a radius equal to the distance from the tilting point of the ladle and vertically to the top of the ladle.

7. The cover arrangement of claim 2 wherein the cover is equipped with a venting pipe.

8. The cover of claim 3 wherein the top of the ladle and the bottom of the cover, in the tilting direction of the ladle, have a curved surface with a radius equal to the distance from the tilting point of the ladle and vertically to the top of the ladle.

9. The cover of claim 4 wherein the top of the ladle and the bottom of the cover, in the tilting direction of the ladle, have a curved surface with a radius equal to the distance from the tilting point of the ladle and vertically to the top of the ladle.

10. In a tiltable ladle which is suspended from a suspension frame and which has a cover for closing the top of said ladle wherein the cover has a basin formed on said cover, the improvement comprising:

a spring means for urging said cover away from said ladle such that when the basin in said cover is empty said cover is not in contact with said ladle; and a suspension means for suspending said cover over said ladle, said suspension means attached to said suspension frame and said cover.

11. The ladle of claim 10 wherein said suspension means comprises a horizontal beam affixed to said suspension frame, and two rods, each of which is atached to said cover and passes through said horizontal beam and is movable with respect to said horizontal beam, each of said two rods having a washer affixed thereto and positioned above said horizontal beam.

12. The ladle of claim 11 wherein said spring means comprises two compression springs, one of said compression springs positioned around one of said two rods and between said horizontal beam and said washer and the other of said two compression springs positioned around the other of said two rods and between said horizontal beam and said washer.

13. The ladle of claim 10 wherein the top of the ladle and the bottom of the cover, in the tilting direction of the ladle, have a curved surface with a radius equal to the distance from the tilting point of the ladle and vertically to the top of the ladle.

14. The ladle of claim 10 wherein the cover is equipped with a venting pipe.

* * * * *